US008123156B2

(12) United States Patent
Mishima et al.

(10) Patent No.: US 8,123,156 B2
(45) Date of Patent: Feb. 28, 2012

(54) YARN PATH GUIDE, TRAVERSING DEVICE OF FIBER BUNDLE AND SYSTEM FOR PRODUCING FIBER BUNDLE PACKAGE

(75) Inventors: Kunihiro Mishima, Otsu (JP); Ken Kugita, Otsu (JP); Hidetaka Matsumae, Iyo-gun (JP); Shota Sakimura, Tatsuno (JP); Seiji Tsuji, Takatsuki (JP)

(73) Assignee: Toray Industries, Inc. (JP)

( * ) Notice: Subject to any disclaimer, the term of this patent is extended or adjusted under 35 U.S.C. 154(b) by 780 days.

(21) Appl. No.: 10/586,413

(22) PCT Filed: Apr. 14, 2004

(86) PCT No.: PCT/JP2004/005293

§ 371 (c)(1),
(2), (4) Date: Jul. 19, 2006

(87) PCT Pub. No.: WO2005/073118

PCT Pub. Date: Aug. 11, 2005

(65) Prior Publication Data

US 2007/0163226 A1 Jul. 19, 2007

(30) Foreign Application Priority Data

Jan. 28, 2004 (JP) ..... 2004-020200

(51) Int. Cl.
*B65H 54/28* (2006.01)

(52) U.S. Cl. ..... 242/476.7; 242/615.1

(58) Field of Classification Search ..... 242/615.21, 242/472.8, 471, 157.1, 476.7, 157 R, 615, 242/615.1; 226/21, 23
See application file for complete search history.

(56) References Cited

U.S. PATENT DOCUMENTS

| | | | | | |
|---|---|---|---|---|---|
| 270,718 | A | * | 1/1883 | Albey | 474/106 |
| 296,222 | A | * | 4/1884 | Schubiger | 474/106 |
| 3,244,340 | A | * | 4/1966 | Fife et al. | 226/22 |
| 3,986,650 | A | * | 10/1976 | Swanke et al. | 226/21 |
| 4,174,171 | A | * | 11/1979 | Hamaker et al. | 399/165 |
| 4,212,422 | A | * | 7/1980 | Rauchfuss et al. | 226/23 |
| 4,572,417 | A | * | 2/1986 | Joseph et al. | 226/20 |
| 4,913,328 | A | * | 4/1990 | Schulz | 226/21 |
| 4,961,089 | A | * | 10/1990 | Jamzadeh | 399/165 |
| 4,989,799 | A | * | 2/1991 | Nakai et al. | 242/472.8 |
| 5,276,460 | A | * | 1/1994 | Miyajima | 347/217 |
| 5,479,241 | A | * | 12/1995 | Hou et al. | 399/75 |
| 5,499,776 | A | * | 3/1996 | Nojiri et al. | 242/178 |
| 5,881,939 | A | * | 3/1999 | Kikuchi et al. | 226/180 |

FOREIGN PATENT DOCUMENTS

| | | | |
|---|---|---|---|
| JP | 61-11169 | Y2 | 4/1986 |
| JP | 62-170535 | A | 7/1987 |
| JP | 2845636 | B2 | 1/1999 |
| JP | 3194765 | B2 | 8/2001 |
| JP | 2001-348166 | A | 12/2001 |

* cited by examiner

*Primary Examiner* — William E Dondero
(74) *Attorney, Agent, or Firm* — DLA Piper LLP (US)

(57) ABSTRACT

A traversing device for stabilizing the yarn path of a thin and uniform flat fiber bundle without causing any trouble, e.g. entanglement of single fibers, and ensuring a good winding appearance of the winding package of fiber bundle, and a yarn path guide for stabilizing the yarn path without causing any trouble, e.g. entanglement of single fibers.

6 Claims, 7 Drawing Sheets

(a) Plane view (b) Front view (a) Plane view (b) Front view

YARN PATH GUIDE, TRAVERSING DEVICE OF FIBER BUNDLE AND SYSTEM FOR PRODUCING FIBER BUNDLE PACKAGE

TECHNICAL FIELD

The present invention concerns a traversing device permitting to obtain a fiber bundle package enabling not to apply unnecessary external force to a tape-like fiber bundle having an spread flat cross section, such as a flat yarn when the fiber bundle is wound around a bobbin and to wind without twisting or fluffing and, as a result, also during the unwinding of a tape-like fiber bundle such as a flat yarn, enabling to unwind as it is, with good refining and without deforming the tape-like shape and a method for producing such a fiber bundle package.

The present invention concerns a yarn path guide which is not limited to the case of being used for such a traversing device, but is effective for stabilizing the yarn path without causing any trouble such as entanglement of single fibers.

BACKGROUND ART

Concerning many of fibers used for resin reinforcement represented by carbon fibers and glass fibers (hereinafter referred to as "reinforcing fibers"), the bundle of these fibers (hereinafter referred to as "reinforcing fiber bundle") is impregnated with matrix resin to obtain a so-called prepreg and, thereafter the same is made into a preform in a predetermined shape, thermally cured and manufactured as fiber-reinforced plastic molding.

These years, along with the weight reducing trend of such fiber-reinforced plastic molding, a high quality prepreg of thin and reduced in thickness irregularity is expected.

When producing such prepreg, it is necessary to open in a thin and wide web without twisting, in order to fully deploy the high elastic modulus property of individual single fibers composing the reinforcing fiber bundle.

Therefore, also for the reinforcing fiber bundle used as an original material of the prepreg, it has become an important subject to wind around a bobbin, beforehand, in such a thin and uniformly spread state, and, to supply to the process for producing the prepreg all the way maintaining this state.

To realize handling such a fiber bundle, especially, it is important not to apply unnecessary external force to the fiber bundle during the conveying and guiding of the fiber bundle and, for instance, regulation of the yarn path by means of a ribbed roll causes the fiber bundle friction and folding and causing troubles, which are not necessarily undesirable. Therefore, it is usual to use a wide guide roll anticipating variation of the yarn path, in other words, allowing variation of the yarn path.

However, the stabilization of the yarn path becomes an important subject, because variation of the yarn path induces deterioration in the quality of the winding package.

As the fiber bundle traveling obliquely on the guide roll also induces the friction of the fiber bundle and deterioration in the quality of the yarn, the stabilization of the yarn path is similarly an important subject.

On the other hand, in the ordinary fiber bundle winding device, the fiber bundle is traversed in the shaft direction of the bobbin by a traverse guide reciprocating parallel to the rotating shaft of the winding bobbin and wound.

In such traversing device, the stabilization of the yarn path is an important subject, variation of the yarn path disordering the winding package and deteriorating in the quality of the package.

Besides, if a fiber bundle is pulled laterally, the fiber bundle travels obliquely on the guide roll. Like this, if a fiber bundle does not travel straight in the circumferential direction of the guide roll, but travels obliquely on the guide roll, friction occurs in the fiber bundle, deteriorating in the quality of the fiber bundle.

Conventionally, as the fiber bundle winding device for winding flat tape-like reinforcing fiber bundle spread thin beforehand as mentioned above with a stable yarn width (width of fiber bundle) from the beginning to the end of winding, FIG. 2 of Japanese Patent Laid-Open No. 2001-348166 proposes a fiber bundle winding device comprising a guide stand reciprocating parallel to the rotating shaft of the winding bobbin, a pair of upper guide rollers arranged at the upper part of the guide stand with the rotating shaft thereof crossing the rotating shaft of the winding bobbin at a right angle, a pair of lower guide rollers arranged at the lower part of said guide stand with the rotating shaft thereof parallel to the rotating shaft of the winding bobbin, and a conical guide roller arranged therebetween for twining the fiber bundle by 90° in the shaft line direction.

Moreover, as winding device having an swing guide, FIG. 5 of Japanese Patent Publication No. 3194765 proposes a winding device or the like for winding a narrow-width belt-like body around a drum all the way crossing the line parallel to the winding direction of the narrow-width belt-like body and the rotating shaft line of said swinging sticking roller at a right angle, by swinging the final sticking roller for sending the narrow-width belt-like body to the winding drum with a normal line to the outer surface of the winding drum as swing center point.

However, these conventional fiber bundle winding devices had drawbacks as mentioned below.

In the fiber bundle winding device disclosed in FIG. 2 of Japanese Patent Laid-Open No. 2001-348166, one of the pair of upper guide rollers set at the upper part of the guide stand is formed into a saddle shape of which outer surface is curved inwards in the middle. As a result, this curved surface restricts the fiber bundle to prevent the yarn path deviating from the original yarn path. However, to restrict the fiber bundle by the saddle-like guide roll is to apply the force in the width direction of the tape-like fiber bundle, causing troubles such as entanglement of single fibers by the collapse of fiber bundle and, moreover, the yarn width of the wound fiber bundle becomes narrower. Moreover, in the publication, saddle-like guide roll are provided at the lower guide for limiting the side slipping of fiber bundle on the lower guide rollers due to the traversing and this also causes the collapse of fiber bundle and entanglement of single fibers, and the yarn width of the wound fiber bundle becomes narrower. Furthermore, conical or saddle-like guide roll generates peripheral speed difference in the yarn width direction, damaging the fiber bundle and deteriorating in the quality.

In addition, FIG. 5 of Japanese Patent Publication No. 3194765 discloses a guide wherein a guide extending in the supplying direction of a narrow-width belt-like body is linked to a bracket supported so as to swingable in the horizontal direction, and the bracket having a drum-like supplying roller of which central part in an axial direction bulges outward. It is described that this allows the guide to direct to the supplying direction of narrow-width belt-like body by swinging the guide in the horizontal direction and the drum-like supplying roller allows substantially centering of the narrow-width belt-like body.

However, in case of the fiber bundle, the use of drum-like roller only widens the fiber bundle width, but centering can not be expected. Moreover, the swinging of the guide directs the guide roll to the supplying direction of narrow-width belt-like body and is effective because the position of narrow-width belt-like body on said supplying roller is fixed, however, in case of the fiber bundle, the yarn path on the supplying roll is unstable, the fiber bundle deviates from the supplying roll, inhibiting the winding.

Similarly, the sticking roller which is the final guide roll is an idea of fixing the travel position of the narrow-width belt-like body using a rib, and can not be applied to the winding of fiber bundle.

SUMMARY

We provide a fiber bundle traversing device for stabilizing the yarn path of a flat fiber bundle required to be wound in a thin and uniformly spread state, without causing any trouble such as entanglement of single fibers, and ensuring a good winding appearance of the winding package of fiber bundle and realizing the quality improvement, and a manufacturing method of fiber bundle package using the fiber bundle traversing device.

Moreover, we provide a new yarn path guide which is not limited to the case of being used for the aforementioned traversing device, but is effective for stabilizing the yarn path without causing any trouble such as entanglement of single fibers, further propose a manufacturing apparatus of fiber bundle package using the yarn path guide.

The yarn path guide for guiding a traveling yarn, comprises a guide roll and a supporting member that supports the guide roll, wherein the supporting member has a rotating shaft at a position twisted at a right angle to the rotating shaft of the guide roll, and the yarn path guide is arranged such that the guide roll is inclined with respect to the yarn path through rotation around the rotating shaft of the supporting member in response to variation of the yarn path and the fiber bundle is guided automatically in the yarn path direction.

A manufacturing apparatus of fiber bundle package comprises the aforementioned path guide.

A fiber bundle traversing device

That is to say, it concerns a fiber bundle traversing device comprising a traverse guide for guiding the fiber bundle and a traverse mechanism of the traverse guide, and traversing the fiber bundle by reciprocating said traverse guide in the direction of the bobbin rotating shaft by means of the traverse mechanism, wherein said traverse guide has a yarn guide mechanism for guiding the fiber bundle performing such an operation that the traverse guide deviates from the yarn path in the original yarn path direction.

More particularly, it concerns a fiber bundle traversing device using the aforementioned yarn path guide as the guide mechanism.

Another fiber bundle traversing device

That is to say, it concerns a fiber bundle traversing device comprising a traverse guide for guiding the fiber bundle and a traverse mechanism of the traverse guide, and traversing the fiber bundle by reciprocating said traverse guide in the direction of the bobbin rotating shaft by means of the traverse mechanism, wherein said traverse guide comprises, at least, an upper guide roll of which a roll rotating shaft is arranged at a position twisted substantially at a right angle to said bobbin rotating shaft and a final guide roll of which the roll rotating shaft of is arranged substantially parallel to said bobbin rotating shaft, wherein these upper guide roll and final guide roll are arranged respectively such that the rotating shaft direction of the guide roll and the direction of the yarn path entering the guide roll cross substantially at a right angle.

Moreover, a fiber bundle winding device comprises the aforementioned fiber bundle traversing device.

Besides, a manufacturing method of fiber bundle package is a manufacturing method of fiber bundle package using the fiber bundle traversing device or the fiber bundle winding device.

According to the aforementioned yarn path guide, a new yarn path guide for stabilizing the yarn path without causing any trouble, e.g. entanglement of single fibers can be provided.

According to the manufacturing apparatus of fiber bundle package, a fiber bundle package which has a stable and good winding appearance and can be handled easily in the higher order processing steps can be provided.

According to the fiber bundle traversing device, the traversing can be stabilized and a well-balanced traversing and winding can be ensured, a fiber bundle package which has a stable and good winding appearance and can be handled easily in the higher order processing steps can be provided.

According to the fiber bundle winding device, a fiber bundle package which has a stable and good winding appearance and can be handled easily in the higher order processing steps can be provided, because the yarn path is stabilized without causing any trouble such as entanglement of single fibers and moreover the traversing can be stabilized and a well-balanced traversing and winding can be ensured.

Moreover, according to the manufacturing method of fiber bundle package, a fiber bundle package which has a stable and good winding appearance and can be handled easily in the higher order processing steps can be provided.

DESCRIPTION OF SYMBOLS

Figure 1:
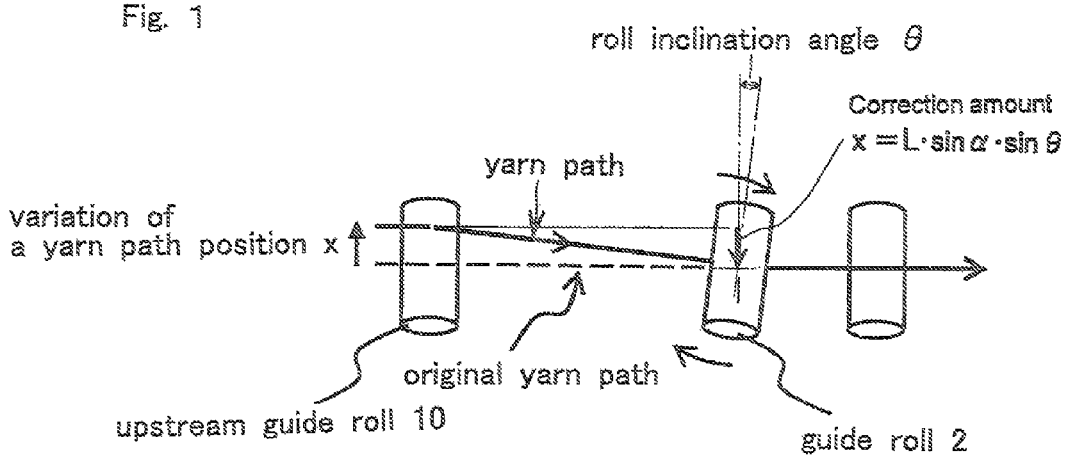
FIG. 1 is a schematic perspective view showing the overall structure of a yarn path guide 1 according to the present invention.
Figure 1:
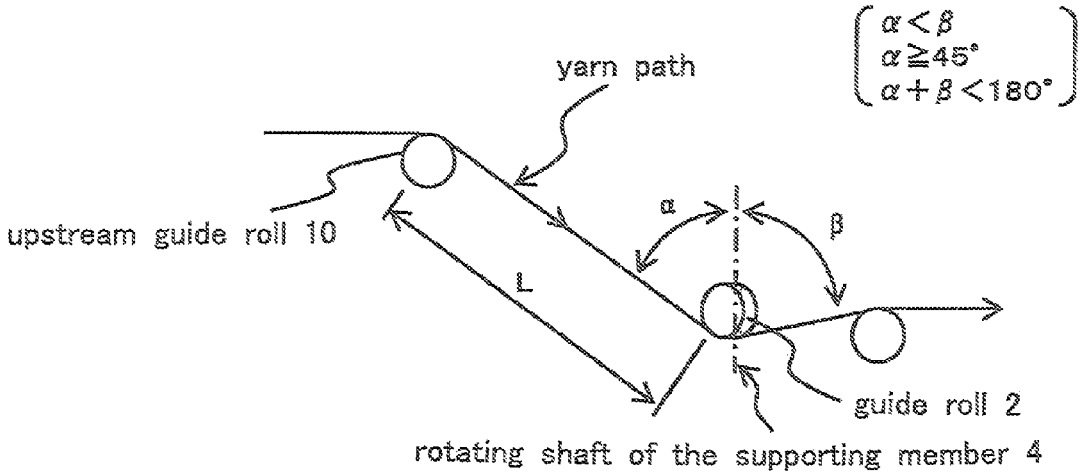

1: Yarn path guide
2: Guide roll
3: Supporting member

4: Rotating shaft of supporting member
5: Traversing device
6: Traverse guide
7: Package
8: Winding device
9: Rotating shaft of guide roll
10: Upstream guide roll
11: Downstream guide roll
12: Yarn path guide
13: Pressure roll
14: Upper guide roll
15: Intermediate guide roll
16: Final guide roll
P: Traverse direction
Y: Yarn (fiber bundle)
α: Angle between the rotating shaft direction 4 of the supporting member and the original yarn path entering the guide roll 2
β: Angle between the rotating shaft direction 4 of the supporting member and the original yarn path coming out of the guide roll 2

DETAILED DESCRIPTION

A representative yarn path guide and fiber bundle traversing device will be more concretely described with reference to FIGS. 1-9.

F*ig*. 1 is a schematic model perspective view showing in a model-like manner the overall structure of yarn path guide 1 according to the present invention. The yarn path guide 1 according to the present invention guides traveling yarn (fiber bundle) Y and comprises a guide roll 2 and a supporting member 3 that supports the guide roll. The supporting member 3 has a rotating shaft 4 at position twisted at a right angle in the rotating shaft direction of the guide roll 2 and is constituted so that the yarn (fiber bundle) can be guided automatically in the central direction of the original yarn path (yarn path set based on the position of supporting the traveling yarn on the upstream and downstream side. In terms of the device constitution, the set yarn path. It does not need to be straight and may have the region or the range.) by inclining the guide roll 2 with respect to the yarn path through rotation around the rotating shaft 4 of the supporting member, in response to variation of the yarn path (actual path of the traveling yarn).

In the present invention, the guide roll 2 is preferably constituted as free rotating roll that can rotate by subjecting to the yarn traveling speed. This is preferable, because it hardly apply ironing to the yarn and hardly adversely affects the yarn quality.

In addition to that the shape of the guide roll 2 should preferably be cylindrical. This is preferable, because of the peripheral speed difference on the roll surface as in the case of using a conical or saddle-like roll and this hardly adversely affects the yarn quality.

In the yarn path guide according to the present invention, concerning the rotating shaft 4 of the supporting member, it is preferable that the device is constituted such that the rotating shaft 4 of the supporting member may cross the original yarn path. This constitution makes right and left inclinations of the guide roll 2 equal, thus making the inclination of the guide roll 2 smoother, and hence the yarn can be guided more effectively and appropriately to the original yarn path.

In addition, when the angle between the rotating shaft direction 4 of the supporting member and the original yarn path entering the guide roll 2 is α and the angle between the rotating shaft direction 4 of the supporting member and the original yarn path coming out of the guide roll 2 is β, it is preferable that α and β have the relation $\alpha<\beta$. When this relation is satisfied, the yarn can be guided more effectively and appropriately to the original yarn path, because the total path length of the yarn path where the guide roll 2 is inclined in the direction of guiding the yarn path in the original yarn path direction less than the path length at the neutral position where the guide roll is not inclined. α is preferably 45° or more. If α is less than 45°, the fiber bundle can not be effectively guided in the original yarn path direction, because the change in the angle between the yarn path entering the guide roll and the ridge angle of the guide roll 2 is small even if the guide roll 2 is inclined.

The aforementioned yarn path guide according to the present invention has a great effect when used in a manufacturing apparatus of fiber bundle package (winding device, take-up device). The traveling of the yarn along the normal set yarn path enables winding neatly the fiber bundle package in accordance to the expected design.

Consequently, the yarn path guide of the present invention is more effective, if applied to the manufacturing step of fiber bundle package where it is difficult to neatly wind up particularly, for instance, where the yarn travels in the tape-like or wide width state and it is required to be wound while maintaining this shape.

An example of usage as a fiber bundle traversing device, in the winding device section of the manufacturing step of fiber bundle package wherein a yarn travels in such a tape-like or wide width state and is required to be wound while maintaining this shape, shall be shown, and described below.

Figure 3:
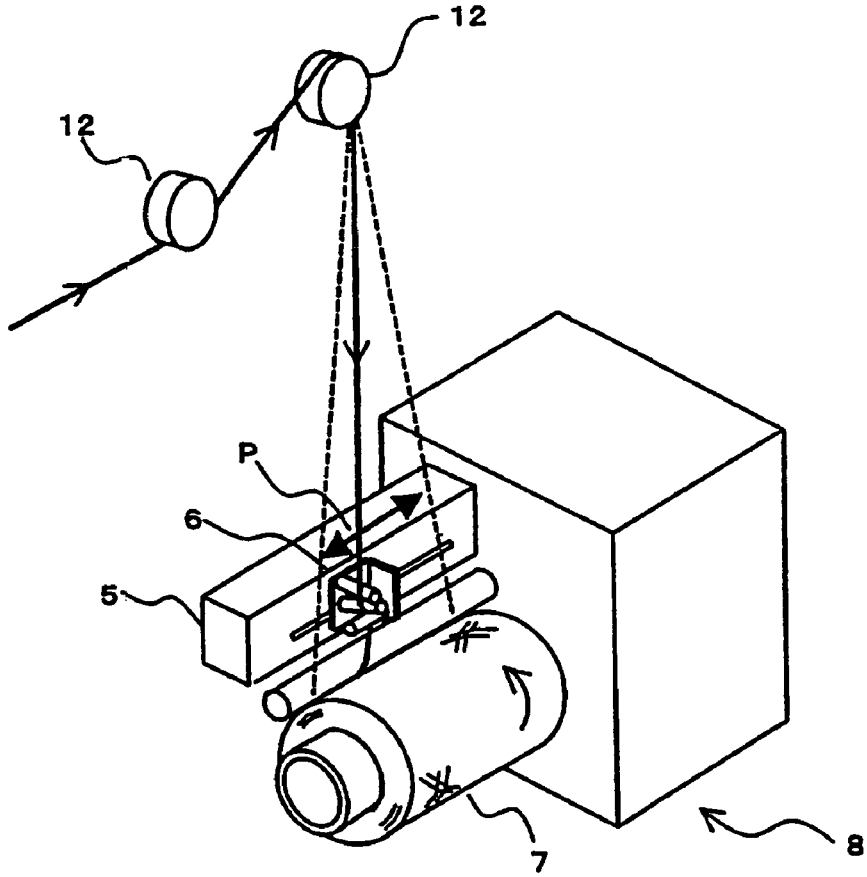
FIG. 3 is an appearance model perspective view showing the overall view of a traversing device and a winding device.

FIG. 3 is an appearance model perspective view showing the overall view of the traversing device 5 and the winding device 8, the traversing device 5 having a traverse guide 6 for guiding the fiber bundle. Moreover, FIG. 4(*a*) is a schematic view of the traverse guide 6 section and FIG. 4(*b*) is a schematic view of the upper guide roll 14.

Figure 6:
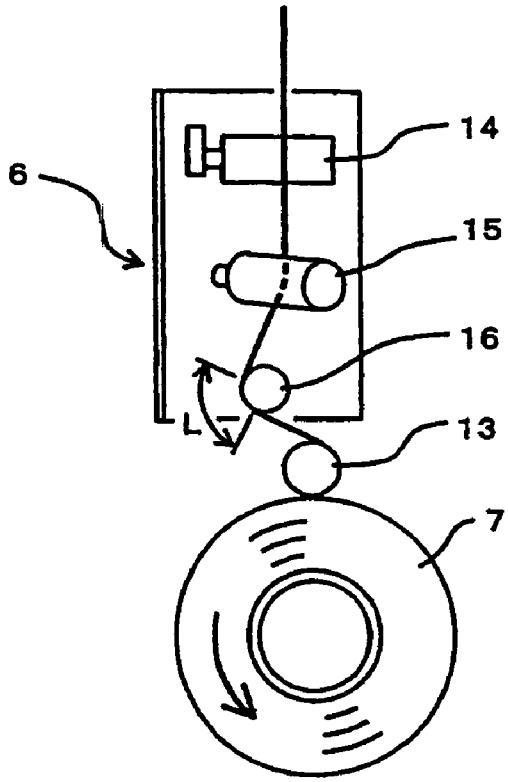
FIG. 6 is a schematic view of the traverse guide section viewed from the rotating shaft direction of the winding bobbin.
Figure 7:
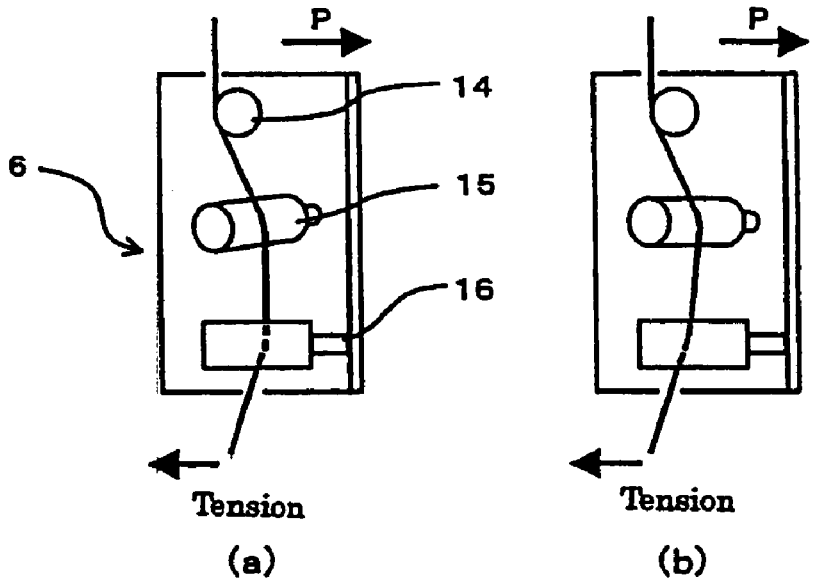
FIG. 7(*a*) is a schematic view of the traverse guide according to the present invention viewed from the bobbin rotating shaft direction parallel to the sheet surface and FIG. 7(*b*) is a schematic view of a traverse guide according the prior art viewed from the bobbin rotating shaft direction parallel to the sheet surface.
Figure 8:
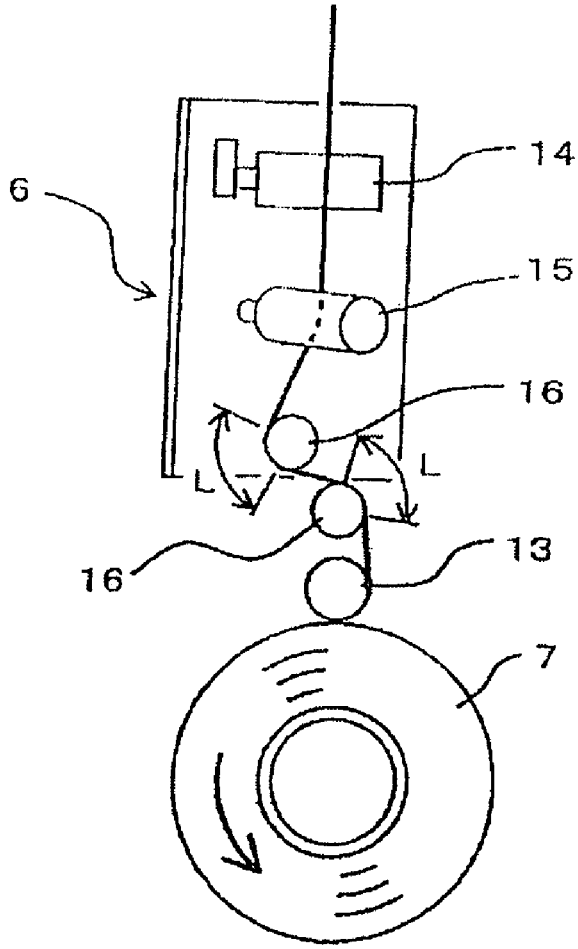
FIG. 8 is a schematic view of another traverse guide section viewed from the rotary shaft direction of the winding bobbin.
Figure 9:
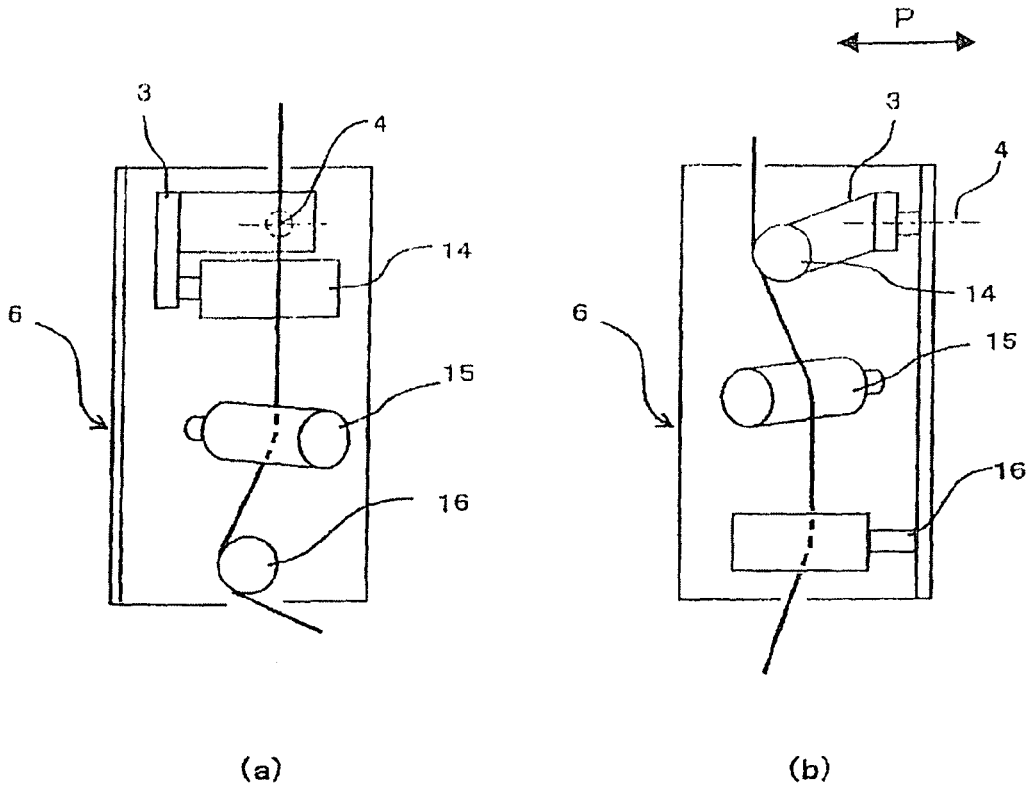
FIG. 9 includes a side view (*a*) and a front view (*b*) of the roll rotating shaft of the upper guide roll arranged on the downstream side of the yarn path.

FIG. 6 is a view of the traverse guide 6 viewed from the rotating shaft direction of the winding bobbin, and FIG. 7 is a schematic view of the traverse guide viewed from the bobbin rotating shaft direction parallel to the sheet surface.

Referring to FIG. 3, a schematic flow of the fiber bundle in the winding device 8 will be described; the fiber bundle from upstream steps (not shown) having passed through a final yarn path guide 12 via conveying rolls is supplied a traversing motion with said yarn path guide 12 as fulcrum, from a traverse guide 6 reciprocating in P direction shown by an arrow in the drawing and is wound finally by winding bobbin.

The traverse guide 6 section is not especially limited in its concrete structure; however, it is important to have a yarn guide mechanism for guiding, at least, the fiber bundle Y deviating from the yarn path in the original yarn path direction. Because, especially, it concerns a step immediately before winding up fiber bundle as package and, here, an appropriate execution of traverse becomes an important element for deciding the final winding appearance of the package.

Figure 4:
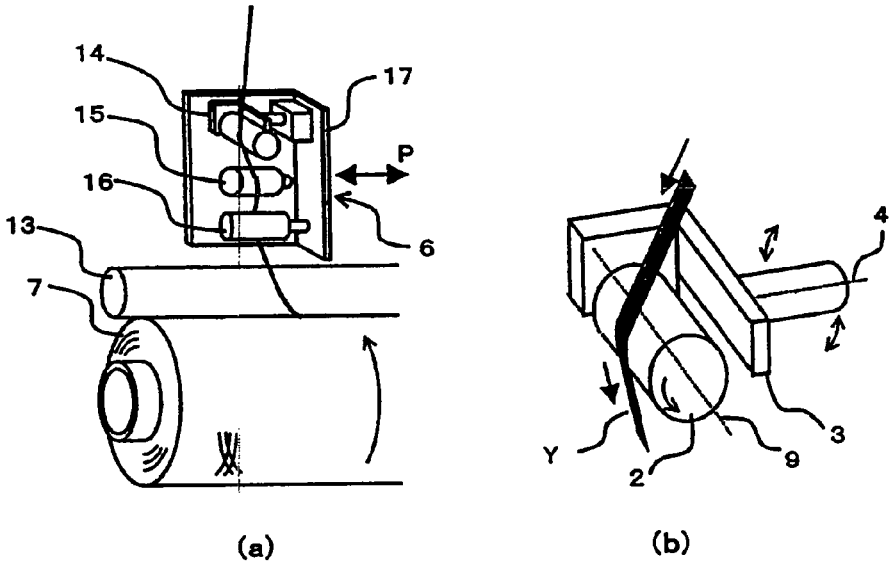
FIG. 4(*a*) is a schematic view of a traverse guide section and FIG. 4(*b*) is a schematic view of an upper guide roll.

A schematic view of the traverse guide 6 section of the traversing device according to the present invention is shown in FIG. 4.

In this example also, the traverse guide 6 section consists of three guide rolls, and the aforementioned yarn path guide of claim 1 according to the present invention is constituted at the most upstream guide roll 2 section.

Among illustrated three rolls, guide rolls positioned at the center and at the most downstream are not necessarily constituted such that they can be inclined as the yarn path guide of claim 1 according to the present invention and rather they are preferably fixed, because the original yarn path can be ensured easily. Moreover, these rolls are preferably free rotating rolls that can rotate in accordance with the yarn traveling.

Besides, the central roll among these three rolls helps to maintain the flat shape of the tape-like flat fiber bundle when the same is twisted by 90° and the traverse guide 6 section may consist of two rolls, namely the upper guide roll and the final guide roll, provided that the fiber bundle shape be stable.

Consequently, a concrete embodiment of the traverse guide is preferably one comprising at least an upper guide roll 14 of which roll rotating shaft is arranged on the bobbin rotating shaft at a position twisted substantially at a right angle, and a final guide roll 16 wherein the roll rotating shaft is arranged substantially parallel to the bobbin rotating shaft direction and, moreover, the aforementioned "yarn guide mechanism for guiding fiber bundle Y deviating from the yarn path in the original yarn path direction" is constituted as the upper guide roll 14.

In case of using the yarn path guide according to claim 1 of the present invention for the traverse guide section, it is preferable that the roll rotating shaft is arranged on the downstream side of the yarn path, with respect to the rotating shaft of the supporting member. This is because, when the yarn path deviates from the original yarn path, the tension of the yarn itself generates moment to incline the upper guide roll 14 and, if the upper guide roll 14 is constituted as mentioned above, the moment to incline the aforementioned upper guide roll 14 increases, permitting to guide the yarn in the original yarn path direction more effectively and more appropriately.

Moreover, as shown in FIG. 7(*a*), it is preferable that the rotating shaft of the guide roll and the yarn path entering the guide roll are arranged at a position twisted substantially at a right angle. In case where the rotating shaft of the guide roll and the yarn path entering the guide roll are not arranged at a position twisted at a right angle as shown in FIG. 7(*b*), the fiber bundle slips on the roll, deteriorating in the yarn quality.

Here, "substantially at a right angle" means that the angle between the rotating shaft of the guide roll and the yarn path entering the guide roll is not required to be exactly 90°, but practically the influence on the yarn quality is sufficiently small if it is within a range of about 90±2°, so it includes this range.

Moreover, the length L of the final guide roll in contact with the fiber bundle is 15 mm or more. Because, if the contact length L is 15 mm or more, the fiber bundle can travel across the guide roll without skipping even if the fiber bundle is pulled right and left by the traversing.

Moreover, it is preferable to have two or more guide rolls where the roll rotating shaft is arranged substantially parallel to the bobbin rotating shaft, including the final guide roll, because this increases the stability of the yarn path. In this case, it is preferable that the total of length L of these rolls in contact with the fiber bundle is 25 mm or more.

Now, the function of the aforementioned yarn path guide and the fiber bundle traversing device shall be described.

Figure 2:
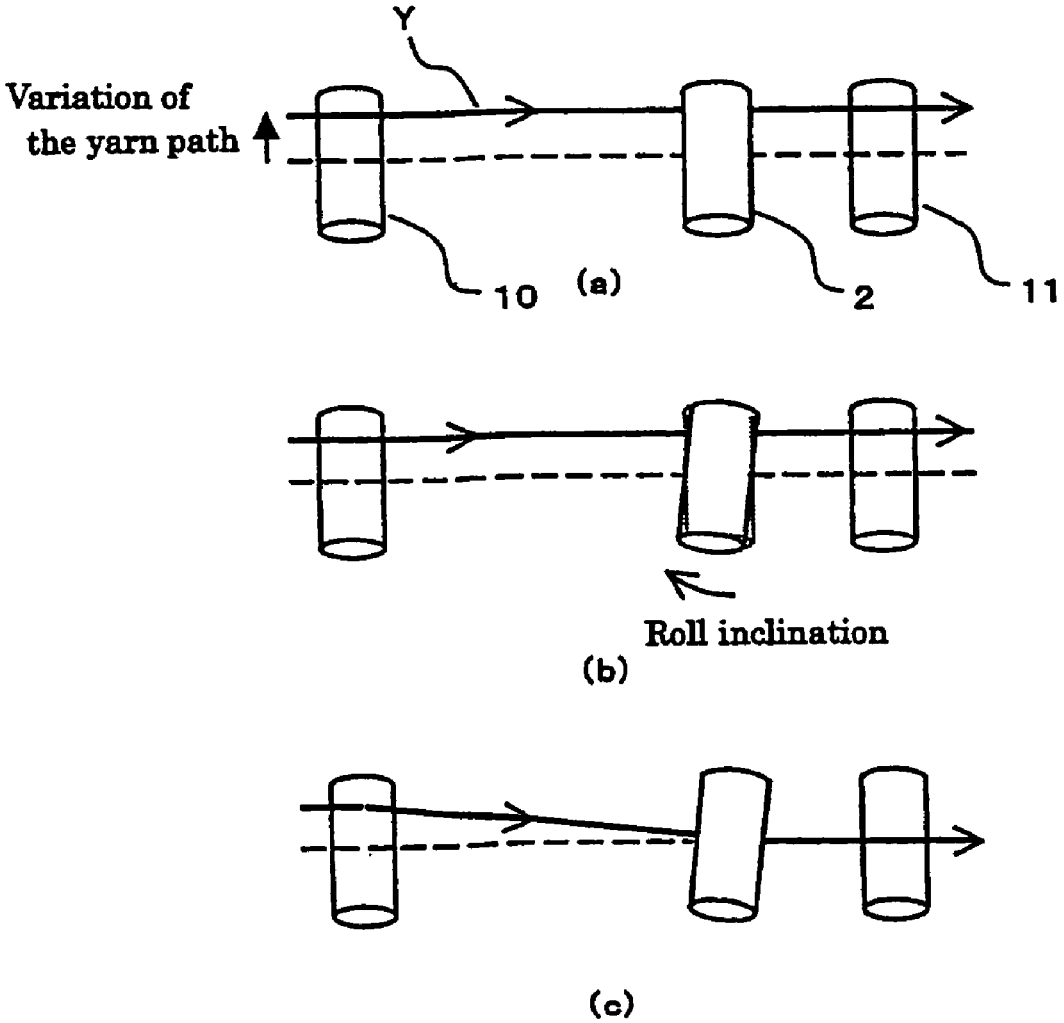
FIGS. 2(*a*), (*b*) and (*c*) illustrate the mechanism that a fiber bundle is guided automatically in the original yarn path direction, when the yarn path changes during the use of the yarn path guide according to the present invention.

FIG. 2 illustrates the operation of the yarn path guide according to the present invention. Here, among three guide rolls, the central guide roll 2 is the yarn path guide according to the present invention, the upstream guide roll 10 and the downstream guide roll 11 being arranged in front of and behind the central guide roll 2.

In general, in case of using a guide roll for conveying and guiding fiber bundle, the fiber bundle takes such a yarn path where the path length thereof becomes the shortest. Therefore, if the fiber bundle does not slip on the guide roll, the fiber bundle enters at a right angle to the rotating shaft of the guide roll.

On the other hand, in a group of guide rolls constituted of rolls having parallel rotating shaft, there is no difference of path length between the original yarn path (broken line in FIG. 2(*a*)) and the yarn path deviated from the original yarn path (solid line in FIG. 2(*a*)), and both yarn path may be taken. There, if the guide roll 2 in the center of the drawing is inclined in response to the deviation (variation) of the yarn path (FIG. 2(*b*)), the deviated yarn path is guided in the original yarn path direction (FIG. 2(*c*)), because the fiber bundle enters the guide roll 2 at a right angle.

Next, FIG. 3 is a perspective view showing the traversing device of the present invention and a winding device comprising the traversing device; and FIG. 4 is a schematic view of a traverse guide 6 section of the traversing device according to the present invention.

Figure 5:
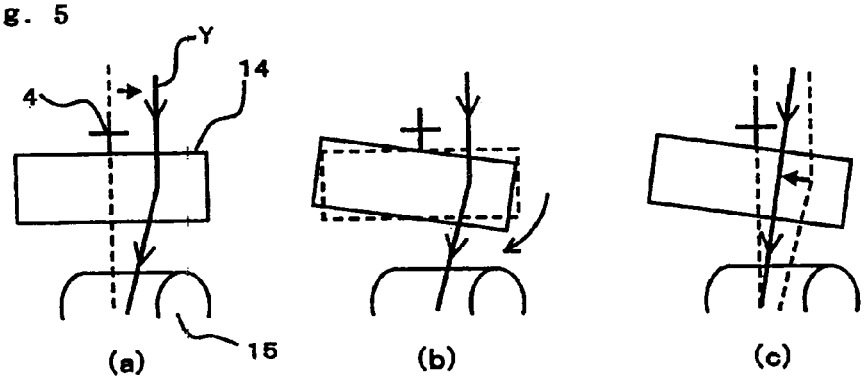
FIG. 5(*a*),(*b*) and (*c*) illustrate the operation of a yarn guide mechanism of a traverse guide according to the present invention.

Moreover, FIG. 5 illustrates the operation of a yarn guide mechanism of a traverse guide according to the present invention.

Tape-like or wide width fiber bundle passes through the yarn path guide and is its tape surface or wide width surface is held and restricted by the upper guide roll 14 positioned on the most upstream side of the traverse guide 6. Next, the fiber bundle is twined by 45° between the upper guide roll 14 and the intermediate guide roll 15, twined further by 45° between the intermediate guide roll 15 and the final guide roll 16, finally the tape surface or wide width surface thereof are arranged parallel to the bobbin rotating shaft, surface pressure is imparted by a pressure roll 13 and wound by a bobbin. Here, the yarn path deviation not shown on the upstream side causes deviation of the yarn path on the yarn path guide 12. This deviation of the yarn path on the yarn path guide 12 deviates also the yarn path entering the upper guide roll 14 (FIG. 5(*a*)). However, this deviation of the yarn path causes the yarn bending and, as a result, turns up to incline (FIG. 5(*b*)) the upper guide roll 14 in the direction to release the yarn bending (clockwise direction in the drawing).

Thus, by the inclination of the guide roll 2 the fiber bundle is guided in the direction twisted at a right angle to the guide roll, namely in the original yarn path direction (FIG. 5(*c*)). Moreover, this operation is executed automatically by the tension of the fiber bundle itself, permitting to control variation of the yarn path effectively.

Next, the fiber bundle passes through the intermediate guide roll 15 and arrives at the final guide roll 16. As shown in FIG. 7, the fiber bundle on the final guide roll 16 is pulled by the tension alternatively to the direction opposite to the movement direction of the traverse guide, according to the reciprocation of the traverse guide. As a result, if the fiber bundle is not held sufficiently by the guide roll, the fiber bundle skips on the guide roll as shown in FIG. 7(*b*) and the angle between the roll rotating shaft of the guide roll and the yarn path entering the guide roll can not be kept right angle. However, by making the length of the guide roll in contact with the fiber bundle sufficiently long, more particularly, 15 mm or more, the yarn skipping can be controlled effectively by the friction between the guide roll and the fiber bundle and a position relation where the roll rotating shaft of the guide roll and the yarn path entering the guide roll are twisted at a right angle can be kept. From the view point of stabilization of the yarn path, the contact length is preferably as long as possible; however it is preferably 50mm or less, if considering the large-scale of the device.

As well as the final guide roll 16, another guide roll where the roll rotating shaft is arranged substantially parallel to the rotating shaft of the winding bobbin, is added to be a set of two guide rolls, stabilizing the yarn path and therefore it is preferable. Moreover, it is preferable that the total length of these guide rolls in contact with the fiber bundle is 25 mm or more. However, considering the large-scale of the device, the number of guide rolls where the roll rotating shaft is arranged substantially parallel to the rotating shaft of the winding bobbin is preferably 3 or less and, the length of these guide rolls in contact with the fiber bundle is preferably 75 mm or less.

After all, in the fiber bundle traversing device, comprising a traverse guide for guiding the fiber bundle and a traverse mechanism of the traverse guide, for traversing the fiber bundle by reciprocating the traverse guide in the direction of the bobbin rotating shaft by means of the traverse mechanism, it is essential that said traverse guide has, at least two guide rolls, namely the upper guide roller arranged at a position where the rotating shaft thereof twisted substantially at a right angle to the rotating shaft of said bobbin and the final guide roll where the roll rotating shaft is arranged substantially parallel to said bobbin rotating shaft, wherein at least the upper guide roll and the final guide roll are arranged respectively so that the roll rotating shaft direction of the guide roll and the yarn path direction entering the guide roll have a positional relation twisted substantially at a right angle.

Also, in case of using a guide roll in the intermediate section, it is preferable to arranged so that the roll rotating shaft direction of the guide roll and the yarn path direction entering the guide roll have a positional relation twisted substantially at a right angle.

In the aforementioned fiber bundle traversing device according to the present invention, it is preferable that the upper guide roll has a yarn path guide mechanism for guiding the fiber bundle deviating from the yarn path in the original yarn path direction and, more particularly, the yarn path guide mechanism has the yarn path guide according to the present invention described in FIG. 1 or FIG. 2.

In the traversing device according to the present invention, the aforementioned mechanism for effectively control variation of the yarn path, realized by using the tension of the yarn itself, can realize the traveling of the fiber bundle following the original predetermined yarn path, even if variation of the yarn path occurs on the upstream side of the traversing device, or even if the fiber bundle is pulled right and left on the downstream side according to the traverse motion. Consequently, the fiber winding package having an expected good winding appearance can be wind.

Now, the present invention shall be described more concretely with reference to examples.

For the measurement of variation of the yarn path according to the present embodiment, both end positions of the fiber bundle width are measured, the center value represents the center of the fiber bundle, and the deviation of center value represents variation amount.

EXAMPLE 1

Using a group of guide rolls as shown in FIG. 2, a tape-like carbon fiber bundle (the number of single fibers is 12000, the diameter of single fiber is 7 μm, the width of fiber bundle is 6 mm, the ratio of the width of fiber bundle to the thickness of fiber bundle is about 60, elastic modulus of the strand is 230 GPa) having polyacrylonitrile-based fiber as precursor fiber was conveyed and guided.

Carbon fiber is supplied by a not shown upstream conveying roll and wound by a not shown winding device provided on the downstream side. Here, the upstream guide roll 10 and the downstream guide roll 11 are free rotating rolls having 30 mm in outer diameter and 60 mm in the width of roll, and a supporting member is fixed to a bracket.

Moreover, a guide roll 2 is a yarn path guide according to the present invention, made of a free rotating roll of 30 mm in outer diameter and 60 mm in the width of roll, and a supporting member is fixed to a bracket via a bearing where the rotating shaft is arranged at a position twisted at a right angle with respect to a rotating shaft 9 of the guide roll. Besides, the angle α between the rotating shaft 4 of the supporting member and the yarn path entering the guide roll 2 is set to 50° and the angle β between the rotating shaft 4 of the supporting member and the yarn path coming out of the guide roll 2 is set to 80°. The distance between the upstream guide roll 10 and the guide roll 2 is set to 800 mm and the distance between the downstream guide roll 11 and the guide roll 2 is set to 300 mm.

When the carbon fiber is conveyed and guided, variation of the yarn path on the upstream guide roll 10 was 10 mm, while variation of the yarn path on the downstream guide roll 11 was 2 mm.

COMPARATIVE EXAMPLE 1

Except that the supporting member of the guide roll 2 is fixed to the bracket without bearing, a group of guide rolls similar to the Example 1 was used to convey and guide the fiber bundle.

As a result, variation of the yarn path on the upstream side was propagated to the downstream side as it is, variation of the yarn path on the upstream guide roll 10 was 10 mm, while variation of the yarn path on the downstream guide roll 11 was 10 mm.

COMPARATIVE EXAMPLE 2

Except that the angle α between the rotating shaft 4 of the supporting member and the yarn path entering the guide roll 2 is set to 70° and the angle β between the rotating shaft 4 of the supporting member and the yarn path coming out of the guide roll 2 is set to 60°, the guide roll similar to the Example 1 was used to convey and guide the fiber bundle.

As a result, the fiber bundle deviated from the guide roll 2 and could not be conveyed and guided.

EXAMPLE 2

In the fiber bundle winding device as shown in FIG. 3 and FIG. 4, a tape-like carbon fiber bundle (the number of single fibers is 12000, the diameter of single fiber is 7 μm, the width of fiber bundle is 6 mm, the ratio of the width of fiber bundle to the thickness of fiber bundle is about 60, elastic modulus of the strand is 230 GPa) having polyacrylonitrile-based fiber as precursor fiber was wound around a bobbin (paper tube) of 80 mm in outer diameter at winding speed of 10 m/min and traverse width of 250 mm. Here, as for all of the guide rolls of the traverse guide 6, free rotating rolls of 22 mm in outer diameter and 40 mm in length was used. Besides, in the upper guide roll 14, the rotating shaft 4 of the supporting member was arranged on the upstream side by 7 mm with respect to the rotating shaft 9 of the guide roll and the supporting member of the intermediate and the most downstream guide rolls were fixed to a main body bracket 17 of the traverse guide.

When the fiber bundle was wound by this winding device, variation of the yarn path on the upstream guide roll 14 was 10 mm, while variation of the yarn path on the final guide roll 16 was 1 mm or less. Besides, the obtained carbon fiber bundle package was a fine package presenting uniform package end faces.

COMPARATIVE EXAMPLE 3

Except that the supporting member of the guide roll 2 is fixed directly to the bracket, the fiber bundle winding device unit similar to the Example 2 was used to wind carbon fiber bundle. As a result, variation of the yarn path on the upper guide roll 14 was 10 mm, while variation of the yarn path on the final guide roll was 3 mm or more, and the obtained winding package also presented irregular package end faces and low quality.

COMPARATIVE EXAMPLE 4

Except that the rotating shaft 9 of the guide roll was arranged on the upstream side by 5 mm with respect to the rotating shaft 4 of the supporting member of the guide roll 2, the fiber bundle winding device similar to the Example 2 was used to wind the carbon fiber bundle.

As a result, in response to variation of the yarn path, the upper guide roll 14 was inclined in the direction for guiding the fiber bundle opposite to the original yarn path direction, the fiber bundle deviated from the upper guide roll 14 and could not be wound.

EXAMPLE 3

In the fiber bundle winding device as shown in FIG. 3 and FIG. 6, a tape-like carbon fiber bundle (the number of single fibers is 12000, the diameter of single fiber is 7 μm, the width of fiber bundle is 6 mm, the ratio of the width of fiber bundle to the thickness of fiber bundle is about 60, elastic modulus of the strand is 230 GPa) having polyacrylonitrile-based fiber as precursor fiber was wound around a bobbin (paper tube) of 80 mm in outer diameter at winding speed of 10 m/min and traverse width of 250 mm. Here, as for all of guide rolls of the traverse guide 6, free rotating rolls of 22 mm in outer diameter and 40 mm in length. Besides, the length L of the final guide roll 16 in contact with the fiber bundle was set to 15 mm.

When the fiber bundle was wound by this winding device, variation of the yarn path on the final guide roll 16, due to reciprocation of the traverse guide was 1 mm or less. Besides, the quantity of fluff wrapped around the final guide roll 16 after 50 hours of winding operation was 0.8 mg.

COMPARARTIVE EXAMPLE 5

Except that the length of the final guide roll 16 in contact with the fiber bundle was set to 10 mm, the fiber bundle winding device similar to the Example 3 was used to wind carbon fiber bundle.

As a result, variation of the yarn path on the final guide roll 16, due to reciprocation of the traverse guide was 5 mm. Besides, the quantity of fluff wrapped around the final guide roll 16, after 50 hours of winding operation was 2.5 mg.

EXAMPLE 4

The upper guide roll 14 was arranged so that the rotating shaft 4 of the supporting member can be on the upstream side by 7 mm with respect to the rotating shaft 9 of the guide roll, and the final guide roll 16 and the guide roll parallel to the final guide roll was provided as lower guide roll, and they were arranged so that the total length of these guide rolls in contact with the fiber bundle can be 25 mm. In addition, an intermediate guide roll was arranged between the upper guide roll and the lower guide roll. The intermediate guide roll was inclined in response to the yarn path, so that the rotating shaft of the guide roll can be perpendicular to the yarn path entering the guide roll, because the yarn path becomes slant, if the intermediate guide roll is pressed against the fiber bundle.

Using this traverse guide, winding was performed with winding conditions similar to the Example 3.

As a result, both of long-period variation of the yarn path by upstream variation and short-period variation of the yarn path with the reciprocation of the traverse guide were 1 mm or less on the final guide roll. Besides, the quantity of fluff wrapped around the final guide roll 15, after 50 hours of winding operation was 0.6 mg.

INDUSTRIAL APPLICABILTITY

The fiber bundle traversing device according to the present invention can be applied preferably to the textile industry, especially, when winding around a bobbin, for instance, a tape-like fiber bundle having an spread and flat cross-section shape, such as flat yarn, by traversing.

Moreover, in the textile industry, the traversing device have an effect of stabilizing the yarn path, without causing any trouble, e.g. entanglement of single fibers, and the yarn path guide of the present invention can be used largely in the textile industry, without limiting to the case of traversing.

What is claimed is:

1. A yarn path guide for guiding traveling yarn comprising:

a guide roll; and a supporting member that supports the guide roll, the supporting member having a rotating shaft at a position twisted at a right angle to a rotating shaft of the guide roll, and wherein a fiber bundle is guided automatically in an original yarn path direction by inclining the guide roll with respect to the yarn path when the guide roll is rotating around the rotating shaft of the supporting member in response to variation of the yarn path, when an angle between the rotating shaft of the supporting member and the original yarn path entering the guide roll is $\alpha$ and an angle between the rotating shaft of the supporting member and the original yarn path coming out of the guide roll is $\beta$, and $\alpha$ and $\beta$ have the relation of $\alpha \geqq 45°$, $\alpha < \beta$ and $\alpha + \beta < 180°$.

2. The yarn path guide of claim 1, wherein an axis of the rotating shaft of the supporting member crosses the original yarn path at one portion.

3. A manufacturing apparatus of a fiber bundle package comprising the yarn path guide of claim 1.

4. A method of manufacturing the fiber bundle package of claim 3 comprising supplying a fiber bundle to the yarn path guide.

5. A fiber bundle traversing device, comprising a traverse guide for guiding the fiber bundle and a traverse mechanism of the traverse guide, for traversing the fiber bundle by reciprocating the traverse guide in the direction of a bobbin rotating shaft by the traverse mechanism, wherein the traverse guide has a yarn path guide for guiding the fiber bundle comprising the yarn path guide of claim 1.

6. The fiber bundle traversing device of claim 5, wherein an axis of the rotating shaft of the supporting member crosses the center of the yarn path.

* * * * *